US005305593A

United States Patent [19]

Rodini et al.

[11] Patent Number: 5,305,593

[45] Date of Patent: Apr. 26, 1994

[54] PROCESS FOR MAKING SPUN YARN

[75] Inventors: David J. Rodini, Midlothian, Va.; Donald E. Hoffman, Newark, Del.

[73] Assignee: E. I. Du Pont de Nemours and Company, Wilmington, Del.

[21] Appl. No.: 937,037

[22] Filed: Aug. 31, 1992

[51] Int. Cl.[5] ..... D01H 1/115

[52] U.S. Cl. ..... 57/328; 57/254; 57/255; 57/901

[58] Field of Search ..... 57/253, 254, 255, 901, 57/328; 28/247, 248; 19/46

[56] References Cited

U.S. PATENT DOCUMENTS

| | | | |
|---|---|---|---|
| 2,747,233 | 5/1956 | Hitt | 19/66 |
| 4,145,473 | 3/1979 | Samuelson et al. | 57/901 X |
| 4,263,777 | 4/1981 | Wada et al. | 57/254 X |
| 4,484,436 | 11/1984 | Nakayama et al. | 57/328 |
| 4,497,167 | 2/1985 | Nakahara et al. | 57/328 |
| 4,612,150 | 9/1986 | De Howitt | 264/103 |
| 4,900,495 | 2/1990 | Lin | 57/901 X |
| 5,001,813 | 3/1991 | Rodini | 19/0.46 |
| 5,026,603 | 6/1991 | Rodini | 428/362 |
| 5,107,671 | 4/1992 | Morihashi et al. | 57/328 |

*Primary Examiner*—Joseph J. Hail, III

[57] ABSTRACT

Spun yarns are made at high speeds of up to 220 meters per minute, using spinning techniques in which air is used to twist the fibers of a three component blend, one component of which consists of staple fibers made from electrically conductive filaments having a denier no greater than 2.5 times the denier of the filaments of the other components.

13 Claims, 1 Drawing Sheet

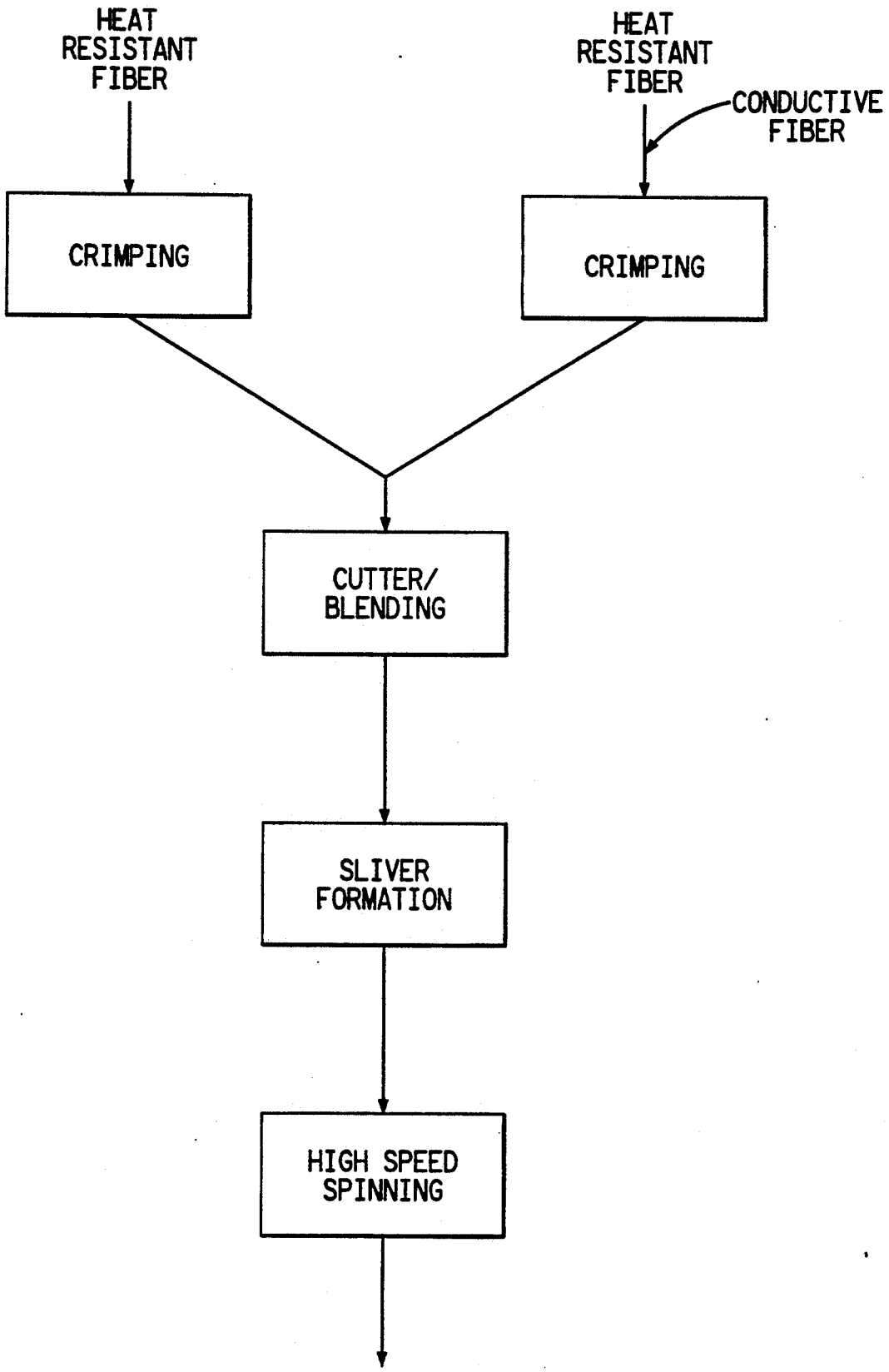
HEAT RESISTANT FIBER
HEAT RESISTANT FIBER
CONDUCTIVE FIBER
CRIMPING
CRIMPING
CUTTER/ BLENDING
SLIVER FORMATION
HIGH SPEED SPINNING

PROCESS FOR MAKING SPUN YARN

BACKGROUND OF THE INVENTION

The field of art to which this invention pertains is spun yarn. The invention is more specifically directed to a process for making such yarn from a three-component blend of staple fibers using high speed, air spinning techniques with spinning speeds in excess of 70 meters per minute. In a preferred embodiment these speeds can range from 150 to 220 meters per minute.

The fiber blend used in the process is formed from a plurality of selected filaments. One component of the blend comprises staple fibers made from filaments having an electrically conductive carbon black core and a sheath of non-conductive polymer. The other two components, which are heat-resistant, are preferably formed from filaments of poly(m-phenylene isophthalamide) and of poly(p-phenylene terephthalamide).

The deniers of the electrically conductive sheath core filaments are preferably no greater than 2.5 times the deniers of the other filaments. This helps prevent or lessens their migration to the surface of the spun yarn during the spinning operation and thereby improves the appearance of the yarn and of the fabrics woven from such yarn.

SUMMARY OF THE INVENTION

In a preferred process of this invention, staple fibers formed from electrically conductive first component filaments having a carbon black core are blended with heat-resistant staple fibers, prior to spinning, to impart desired antistatic properties to a fabric or garment made from such fibers.

In this process, the blend is first formed into a sliver which is processed into a spun yarn using high speed spinning techniques in which a fluid is used to twist the fibers. The most convenient fluid is air, however, other fluids, such as nitrogen could be used. The appearance of the fabric made from these spun yarns is improved provided the denier per filament of the electrically conductive filaments is no greater than about 2.5 times the denier per filament of the filaments used to form the heat-resistant fibers.

Preferably the blend consists of at least two other components, in addition to the first component, electrically conductive fibers. Preferably these components are heat-resistant fibers formed from filaments of poly(m-phenylene isophthalamide) and poly(p-phenylene terephthalamide).

In a preferred embodiment, the denier per filament of the first component filaments used to form electrically conductive staple fibers is about 3.0. The denier per filament of the second component filaments of the poly(p-phenylene terephthalamide) is about 1.5; and, the denier per filament of the third component filaments of poly(m-phenylene isophthalamide) is about 1.7.

The sliver formed from the three-component blend is spun at high speeds in excess of 70 meters per minute, and, preferably, is spun at speeds from 150 to 220 meters per minute. The preferred air spinning technique used to twist the fibers is air-jet spinning.

More specifically, this invention is a process for making a three-component spun yarn comprising the steps of:

forming a first tow from a plurality of heat-resistant filaments;

forming a second tow from a plurality of heat-resistant filaments and a plurality of filaments composed of an electrically conductive carbon black core with a sheath of a non-conductive polymer;

and wherein the denier of the filaments in the tow having the electrically conductive filaments is no greater than 2.5 times the denier of the heat-resistant filaments from either tow;

crimping these tows separately, wherein each tow has between 3 and 6 crimps per centimeter (7.6 to 15.2 crimps per inch);

combining the two crimped tows and cutting the tows to form a three-component blend of staple fibers;

carding and forming a sliver of the three-component blend of staple fibers;

spinning the sliver into a spun yarn with spinning techniques which use air or other fluids to twist the fibers.

In another embodiment, this invention is a process for making spun yarn including the steps of:

forming a plurality of first component filaments each having an electrically conductive carbon black core and a sheath of a non-conductive polymer into a first component yarn;

forming a plurality of second component filaments of non-conductive poly(p-phenylene terephthalamide) into a second component yarn;

forming a plurality of third component filaments of poly(m-phenylene isophthalamide) into a third component yarn;

and wherein the denier of the filaments of the first component yarn is no greater than about 2.5 times the denier of the filaments of the second and third yarns;

combining the first and second component yarns into a first tow;

crimping the first tow, wherein such tow has between 3 and 6 crimps per centimeter (7.6 to 15.2 crimps per inch);

forming the third component yarn into a second tow;

crimping the second tow, wherein such tow has between 3 and 6 crimps per centimeter (7.6 to 15.2 crimps per inch);

combining the crimped first and second tows;

cutting the combined tows to form a three-component blend of staple fibers;

forming the blend of staple fibers into a sliver;

spinning the sliver using air spinning techniques to twist the fibers to form a spun yarn suitable for use in making permanently antistatic fabrics.

In this process the first component yarn prior to processing, comprises from about 1 to 5% of the spun yarn by weight;

the second component yarn from about 1 to 25% of the spun yarn by weight; and the third component yarn comprises at least about 70% of the spun yarn by weight.

BRIEF DESCRIPTION OF THE DRAWING

The FIGURE shows a block diagram of the inventive process.

DESCRIPTION OF THE PREFERRED EMBODIMENTS

The three-component blend of staple fibers of this invention may be spun at high speeds into spun yarns, which can then be made into fabrics having permanent antistatic properties. Such properties are imparted to the fabric by the sheath-core fibers.

Briefly described, in the process of this invention, a tow of spin-oriented electrically conductive sheath-core filaments and non-conductive poly(p-phenylene terephthalamide) (PPD-T) filaments are crimped together and cutter blended with a separately crimped tow of non-conductive poly(m-phenylene isophthalamide) (MPD-I) filaments using a process as described in U.S. Pat. Nos. 5,001,813 and 5,026,603 both to Rodini, the teachings of which are incorporated by reference herein. The blend is then cut into staple and processed into a sliver suitable for use in high speed spinning devices to form spun yarn.

The spinning process is preferably accomplished by an air-jet process similar to that generally shown and described in U.S. Pat. No. 4,497,167 to Nakahara et al., and a teaching of the production of multiply yarns using this method is generally shown and described in U.S. Pat. No. 5,107,671 to Morihashi et al. The teachings of both of these patents are incorporated by reference herein.

The crimping is preferably accomplished in a stuffer box crimper of the type described in U.S. Pat. No. 2,747,233 to Hitt, the teachings of which are incorporated herein by reference.

The PPD-I filaments and MPD-I filaments are heat resistant, that is, they have, either by their inherent nature or by some chemical or other treatment, a limiting oxygen index (L.O.I) of at least 26.5.

The electrically conductive sheath-core filaments which play such a significant role in this invention can be made by the process described in detail, in U.S. Pat. No. 4,612,150 to De Howitt, the teachings of which are incorporated herein by reference.

These conductive filaments have sheaths which can contain additives such as titanium dioxide; the resultant staple fibers are generally light gray in color and are difficult to dye. Such filaments, after further processing, are capable of imparting the desired anti-static properties sought in the garment. This capability would be lost or substantially reduced if these conductive filaments in tow form were crimped alone in a stuffer box crimper prior to being processed into staple fibers. By co-crimping them with the non-conductive filaments, that capability is maintained. As so crimped, the co-crimped tow has a crimp frequency of 3 to 6 uniform crimps per centimeter. This range effectively holds the conductive and non-conductive filaments together in the stuffer box crimper and in the cutter and in subsequent processing without damaging the core of the conductive filaments.

It is important in the practice of the process of this invention that the deniers of the filaments be substantially of the same order. More specifically, the denier of the first component electrically conductive filaments should be no greater than about 2.5 times the deniers of the filaments of the second and third component heat-resistant filaments.

In a preferred embodiment, the denier per filament (dpf) of the poly(p-phenylene terephthalamide) filaments used in the instant process is about 1.5; the dpf of the poly(m-phenylene isophthalamide) filaments is about 1.7; and the dpf of the electrically conductive sheath-core filaments is about 3.0.

Further, preferably, the electrically conductive first yarn made from these filaments comprises from about 1 to 5% of the spun yarn. The non-conductive second component yarn comprises from about 1 to 25% of such spun yarn, and the non-conductive third component yarn comprises at least about 70% of the spun yarn.

The deniers of the filaments is significant because filaments of different sizes and weights tend to behave differently when using the high speed air spinning techniques which play such a key role in the practice of this invention. It has been observed, for example, that in those instances where the deniers of the electrically conductive filaments are over 2.5 times the deniers of the other filaments that some of these heavier filaments are not spun in and tend to rest on the surface of any fabric made from the spun yarn. This detracts from the overall aesthetics or quality of the fabric and tends to give it a hairy or lint-like appearance or look. Further, these electrically conductive filaments, as processed, are difficult to dye, so even a subsequent dyeing operation would in most cases fail to noticeably improve the appearance of the fabric spun from such yarn.

This appearance problem is most frequently evident when high speed air spinning techniques are used to spin the yarn. If slower, ring spinning techniques are used the deniers of the filaments is not important since the electrically conductive filaments, even those having a denier well over 2.5 times the denier of the other filaments, are effectively spun into the yarn (e.g., at ring spinning speeds from about 20 to 30 meters per minute) and do not tend to rest on the surface.

The high speed air spinning techniques used to spin yarns in accordance with this invention are well known to the art.

Preferably, the spinning technique used is a jet spinning technique, and, more specifically, a Murata-type spinning technique is utilized. An air jet may also be used or a vortex formed to twist the yarn.

"Jet spinning" is a type of air spinning in which a core of generally parallel staple fibers are bound together by surface wrapping fibers which usually constitute a minor portion of the population of fibers.

"Jet spinning" processes are also sometimes referred to as "open end" spinning even though all of the fibers are not detached from the drawn sliver at the gap. For example, in Murata jet spinning a portion of the fiber is detached from the drawn sliver and then reassembled and wrapped around the undetached fibers using at least one vortex formed by air jets to form the spun yarn.

Other types of "open end" spinning include rotor spinning, which utilizes a rotor in the gap to help collect the fibers; air can be used to convey and twist the fibers while they are in the gap.

In air jet spinning, speeds from about 150 to 220 meter per minute are obtainable in producing acceptable spun yarns in accordance with this invention. Other air spinning techniques operating at speeds in excess of 70 meters per minute are also usable in obtaining quality yarn having good visual aesthetics.

EXAMPLE 1

A blended tow of undrawn, spin-oriented electrically conductive sheath-core filaments and non-conductive poly(p-phenylene terephthalamide) (PPD-T) filaments were crimped together and cutter blended with a separately crimped tow of non-conductive poly(m-phenylene isophthalamdie) (MPD-I) filaments using a process as described in U.S. Pat. Nos. 5,001,813 and 5,026,603, both to Rodini.

The crimped tows were cut into staple fibers and blended together to form a staple fiber blend consisting of 93% MPD-I filaments, having a 1.7 denier per filament (1.7 dpf); 5% of PPD-T filaments having a 1.5 denier per filament (1.5 dpf); and 2% electrically conductive sheath-core filaments having a 9.3 denier per filament (9.3 dpf).

The staple blend was spun into 30/2 cotton count staple yarns using a "cotton" system process which included carding the staple blend into sliver(s) using a staple processing card with a stationary top, drawing the fibers, preparation of roving, spinning of the roving into yarn using a ring spinning technique (at a speed of 25 meters per minute), followed by twisting and plying of the spun yarns.

These yarns were woven into a Plain Weave, 4.5 Oz./Sq.Yd. fabric.

The fabric was then dyed with cationic dyes. The resulting fabrics are characterized as having good visual aesthetics, i.e., the fabric does not have a "linty" or "hairy" appearance.

EXAMPLE 2

A staple blend was prepared as in Example 1 and spun into 30/2 cotton count yarns using a No. 881 MTS (Murata Twin Spinner) air jet spinner wherein air is used to twist the fibers and the spun yarns are plied two-for-one. This equipment has the capability to spin yarns directly from a sliver and spin at considerably higher spinning speeds than those used in Example 1 (e.g., from 150 to 220 meters per minute). The speed used to prepare the sample was 190 meters per minute. The fibers, prior to spinning, were also subjected to increased carding speeds using a staple processing card with revolving flats and thus were subjected to greater mechanical action as compared to the carding processing used in Example 1.

These yarns were woven into a Plain Weave, 4/5 Oz./Sq.Yd. fabric. The fabric is then dyed with cationic dyes. The resulting fabrics are characterized as having poor visual aesthetics as characterized as a "hairy" or "linty" appearance. Analysis of the fabrics indicates that the "hairy" or "linty" look is due to the electrically conductive sheath-core filaments protruding from or resting on the surface of the fabric.

EXAMPLE 3

A staple blend was prepared as in Example 1, except that the electrically conductive sheath-core filaments were drawn from a 9.3 denier per filament (9.3 dpf) to approximately a 3.0 denier per filament (3 dpf).

This blend was spun into 30/2 cotton count yarns using the Murata yarn processing equipment and speeds as described in Example 2 and employing the same high speed air jet spinning technique. These yarns were woven into a Plain Weave, 4/5 Oz./Sq.Yd fabric.

The fabric is then dyed with cationic dyes. The resulting fabrics are characterized as having good visual aesthetics, that is, the surface of the fabric had little "hairy" or "linty" appearance.

What is claimed is:

1. A process for making spun yarn from a blend of staple fibers formed from a plurality of first, second and third component filaments, wherein the first component is comprised of staple fibers having an electrically conductive carbon black core and a sheath of a non-conductive polymer and the second and third components are comprised of heat-resistant staple fibers, such process including the steps of:

combining the fibers cutter blending the combined fibers to form an intimate three-component blend of staple fibers forming the blend of staple fibers into a sliver, and spinning the sliver into a spun yarn using spinning techniques wherein a fluid is used to twist the fibers, the improvement wherein the denier per filament of the first component filaments is no greater than about 2.5 times the denier per filament of the second and third component filaments and wherein the sliver is spun at speeds in excess of 70 meters per minute.

2. The process of claim 1 wherein the denier per filament of the first component filament is about 3.0; the denier per filament of the second component filament is about 1.5; and, the denier per filament of the third component filament is about 1.7.

3. The process of claim 1 wherein the spinning technique used to twist the fibers is air-jet spinning.

4. The process of claim 1 wherein the sliver is spun at speeds from 150 to 220 meters per minute.

5. The process of claim 1 wherein the heat-resistant staple fibers are poly(m-phenylene isophthalamide) and poly(p-phenylene terephthalamide).

6. The process of claim 1 wherein the fluid used to twist the fibers is air.

7. A process for making a three-component spun yarn comprising the steps of:

forming a first tow from a plurality of heat-resistant filaments;

forming a second tow from a plurality of heat-resistant filaments and a plurality of filaments composed of an electrically conductive carbon black core with a sheath of a non-conductive polymer;

and wherein the denier of the filaments having the electrically conductive carbon black core is no greater than 2.5 times the denier of the heat-resistant filaments from either tow;

crimping these tows separately, wherein each tow has between 3 and 6 crimps per centimeter (7.6 to 15.2 crimps per inch);

combining the tows and cutter blending the tows to form an intimate three-component blend of staple fibers;

carding and forming a sliver of the three-component blend of staple fibers;

spinning the sliver into spun yarns with spinning techniques which use a fluid to twist the fibers and wherein the sliver is spun at speeds in excess of 70 meters per minute.

8. The process of claim 7 wherein the fluid used to twist the fibers is air.

9. A process for making a three-component spun yarn including the steps of:

forming a plurality of first component filaments each having an electrically conductive carbon black core and a sheath of a non-conductive polymer into a first component yarn;

forming a plurality of second component filaments of non-conductive poly(p-phenylene terephthalamide) into a second component yarn;

forming a plurality of third component filaments of poly(m-phenylene isophthalamide) into a third component yarn;

and wherein the denier of the filaments of the first component yarn is no greater than about 2.5 times the deniers of the filaments of the second and third yarns;

combining the first and second component yarns into a first tow;

crimping the first tow, wherein such tow has between 3 and 6 crimps per centimeter (7.6 and 15.2 crimps per inch);

forming the third component yarn into a second tow;

crimping the second tow, wherein such tow has between 3 and 6 crimps per centimeter (7.6 to 15.2 crimps per inch);

combining the crimped first and second tows;

cutter blending the combined tows to form an intimate three-component blend of staple fibers;

forming the blend of staple fibers into a sliver;

spinning the sliver using air spinning techniques to twist the fibers to form a spun yarn suitable for use in making permanently antistatic fabrics and wherein the sliver is spun at speeds in excess of 70 meters per minute.

10. The process of claim 9 wherein the sliver is spun at speeds from 150 to 220 meters per minute.

11. The process of claim 9 wherein the first component yarn comprises from about 1 to 5% of the spun yarn by weight.

12. The process of claim 9 wherein the second component yarn comprises from about 1 to 25% of the spun yarn by weight.

13. The process of claim 9 wherein the third component yarn comprises at least about 70% of the spun yarn by weight.

* * * * *